US005361525A

United States Patent [19]

Bowes

[11] Patent Number: 5,361,525

[45] Date of Patent: Nov. 8, 1994

[54] GUN SAFETY LOCK

[76] Inventor: Kenneth E. Bowes, 2426 Littlebrooke Dr., Dunwoody, Ga. 30338

[21] Appl. No.: 172,740

[22] Filed: Dec. 27, 1993

[51] Int. Cl.[5] ..... F41A 17/02

[52] U.S. Cl. ..... 42/70.11; 42/70.08; 42/70.06

[58] Field of Search ..... 42/70.11, 70.08, 70.06, 42/70.01

[56] References Cited

U.S. PATENT DOCUMENTS

| | | | |
|---|---|---|---|
| 4,261,127 | 4/1981 | Karkkainen | 42/70.11 |
| 4,467,545 | 8/1984 | Shaw, Jr. | 42/70.11 |
| 4,672,763 | 6/1987 | Cunningham | 42/70.11 |
| 4,833,811 | 5/1989 | Wilkinson | 42/70.08 |
| 4,845,870 | 7/1989 | Vernon | 42/70.08 |
| 4,967,502 | 11/1990 | Vernon | 42/70.08 |
| 5,235,763 | 8/1993 | Nosler et al. | 42/70.11 |

FOREIGN PATENT DOCUMENTS

| | | | |
|---|---|---|---|
| 166714 | 1/1986 | European Pat. Off. | 42/70.06 |
| 759409 | 2/1934 | France | 42/70.08 |

*Primary Examiner*—Stephen M. Johnson
*Attorney, Agent, or Firm*—Kenneth S. Watkins, Jr.

[57] ABSTRACT

An improved gun safety lock is disclosed which employs a barrel key to enable the firing mechanism of the gun. The barrel key is inserted in the handle of the gun to allow the hammer of the weapon to be moved into a cocked or firing position. The barrel key is unique for each gun. The barrel key is held in the gun by retaining lugs. A lanyard attaches to the barrel key on one end and to the owner of the gun on the other end. Pressure on the lanyard causes the key to pull out of the gun and thereby disables the gun.

7 Claims, 2 Drawing Sheets

GUN SAFETY LOCK

Background

This invention relates to safety mechanisms for guns.

Many injuries occur each year as guns are fired by unauthorized persons. Children are injured and even killed as they play with loaded guns. Gun owners are killed and wounded when their guns are seized by assailants and used against the owner. Law enforcement officers are injured when assailants grab the officer's handgun and use the gun against the officer.

A number of devices have been disclosed in the past which aim to prevent the firing of a gun by an unauthorized person. Prior art includes plungers which fit up into the handle of the pistol or revolver to allow engagement of the hammer. Removal of the plunger disables the gun. In some cases, the plunger can be attached to the belt of the owner by way of a strap; the strap is designed to pull out the plunger if the gun is seized from the owner. The plunger can be easily duplicated and it is not unique to each gun; therefore, the plunger system can be overridden by use of a duplicate or 'master' plunger.

Other previous patents require a key to 'unlock' the gun so it can be fired. These keyed type safety locks necessitate turning the key in order to disable the gun. Because the key must be turned, the gun owner may not have time or access to disable the gun if it is grabbed by an assailant. Therefore, the keyed type safety lock does not automatically disable the gun if it is seized from its owner and this type of safety lock may not prevent the gun from being used against its owner.

Gun owners need a safety device which prevents firing of the gun by any unauthorized person. The safety device would protect small children who might be tempted to play with a loaded gun. The safety device would also protect the gun owner by preventing an assailant from seizing their gun and using it against them.

The safety device should allow the gun to be operated when the gun is held by the owner but the enabling key of the safety device should automatically pull out of the gun if the gun is seized from its owner. The key of the safety device should also be unique for each gun. Combining the features of a key unique to each gun and yet a key which slips out of the gun if it is seized by an assailant could provide life-saving protection for gun owners and their families.

SUMMARY

My invention is a gun safety lock which is keyed uniquely for each gun. When the key is in the gun, the gun can be fired. The key may also be attached to the body of the owner by a lanyard. If the gun is seized from the owner, the key pulls out of the gun and the gun cannot be fired.

My gun safety lock employs a barrel key which is inserted in the handle of the gun to allow the hammer or the trigger bar of the weapon to be moved into firing position. When the key is not inserted in the handle of the gun, the gun cannot be fired.

The barrel key is held in the handle of the gun by retaining pins which automatically engage upon insertion of the key. The barrel key is inserted into the handle;it is not turned in the handle.

A strap or lanyard attaches to the barrel key on one end and can be secured to the owner on the other end. Because the barrel key is not turned in the handle of the gun, it will be pulled out of the gun by the lanyard if the gun is taken from the owner. If the barrel key is pulled out of the gun, the firing mechanism of the gun is disabled.

The barrel key employs key lugs which are designed in a configuration unique for each gun. Because each barrel key is unique, an unauthorized user cannot enable the firing mechanism by using another key.

The safety lock is recessed into the handle of the gun. The recessed area serves as a guide for the owner to insert the key into the locking mechanism. By using the recessed area, the owner can install the barrel key without visual cues as might be necessary at night. The multiple lug design of the key allows the key to be inserted in at least two positions; this design also speeds arming of the gun in an emergency.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
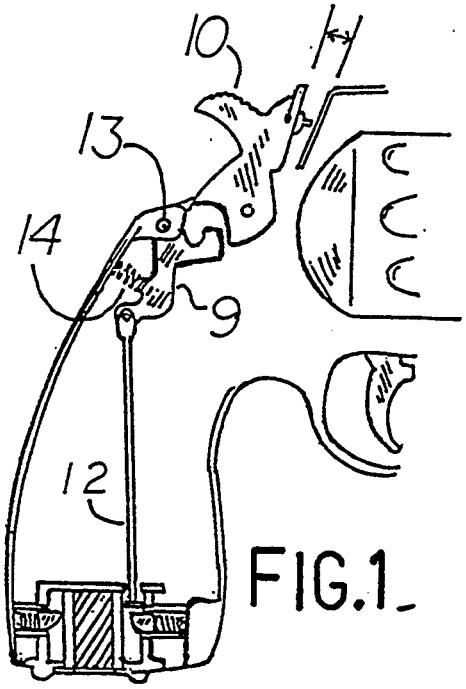
FIG. 1 shows an elevation view of a gun safety lock installed in a revolver and the gun safety lock key.

FIG. 1 depicts a revolver without the key inserted and, therefore, with the firing mechanism disabled. Hammer lock 9 prevents hammer 10 from being pulled back into a cocked or firing position. When key 11 is inserted in the gun, it will push up on enabling bar 12 causing hammer lock 9 to turn on pivot pin 13 and cease to obstruct movement of hammer 10. The hammer can then be cocked and the gun can be fired.

As shown in FIG. 1, lock spring 14 serves to bias hammer lock 9 in a down or locked position until insertion of key 11 causes movement of enabling bar 12 in an upward direction which causes hammer lock 9 to turn on pivot pin 13 and push against lock spring 14.

Figure 2:
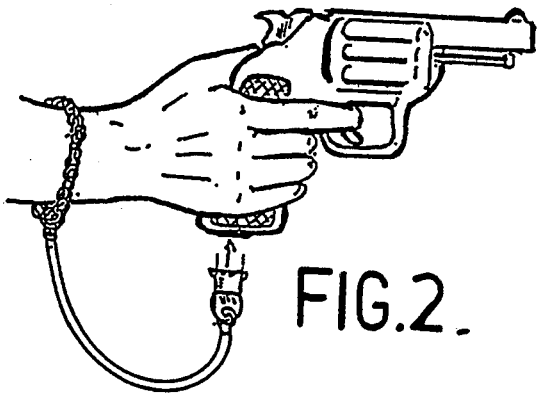
FIG. 2 shows an elevation view of a revolver with the lanyard around a person's wrist.

The strap or lanyard 15 secures to key 11 on one end and to the owner on the other end. The lanyard can be attached to the owner's belt or to the wrist as shown in FIG. 2.

Figure 3:
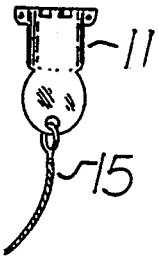
FIG. 3 shows an enlarged elevation of the lower part of a handgun handle with a gun safety lock installed.
Figure 3:
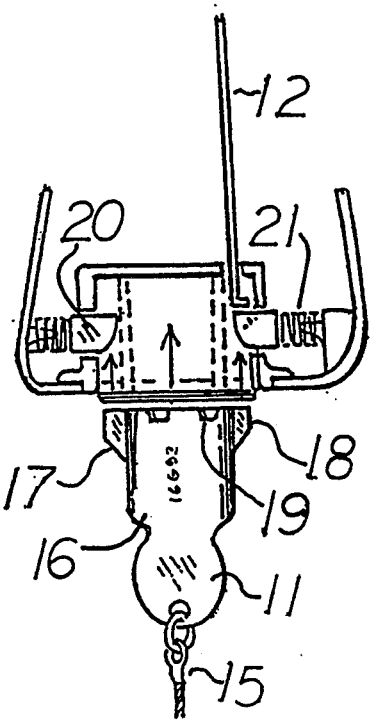

As shown in FIG. 3, the key 11 attaches to lanyard 15. The barrel 16 of the key is an open cylinder. Retaining lugs 17 and 18 are located 180 degrees from each other and they protrude at the base of barrel 16, securing key 11 in the gun. Key lugs 19 also protrude at the base of barrel 16; the key lugs are uniquely configured for each gun and prevent the unauthorized use of the gun by preventing another barrel key from being used in the gun. Key lugs 19 are grouped with each group having the same number of key lugs and having the same relative spacing between the key lugs, and each group of key lugs having the same relative position with respect to a retaining lug. This allows the key to be inserted in either of two orientations which are 180 degrees from each other.

As shown in FIG. 3, insertion of key 11 causes retaining lugs 17 and 18 to press retaining pins 20 against retaining springs 21 and thereby slip past retaining pins 20 which serve to hold the key in the gun. Retaining lug 18 pushes up on enabling bar 12.

Figure 4A:
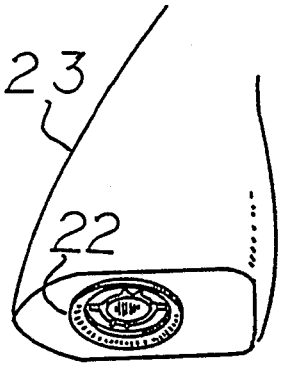
FIG. 4A shows a perspective view of the bottom of a handgun handle.
Figure 4B:
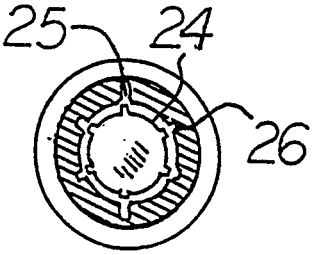
FIG. 4B shows a bottom cross-section of the keylock recess.
Figure 5:
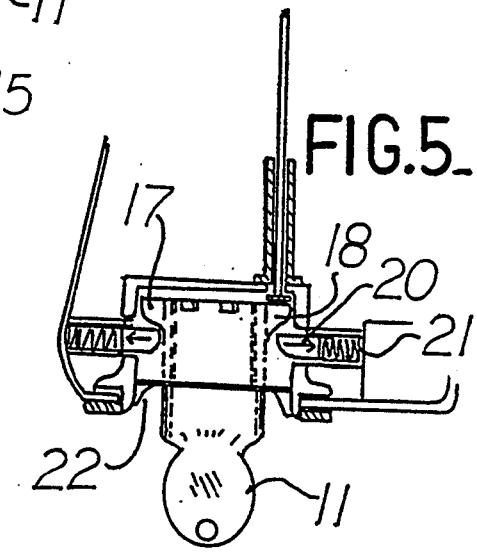
FIG. 5 shows an elevation of the gun safety lock recessed in the handle of a handgun.

FIG. 4A shows bottom view of the keylock recess 22 which fits in the base of gun handle 23. As shown in FIG. 4B, the barrel of the key fits in barrel aperture or slot 24. The retaining lugs on the key fit in retaining lug slots 25 and the key lugs on the key fit in key slots 26. Retaining lug slots 25 and key slots 26 allow full insertion of the key as best seen in FIG. 5. The two retaining lug slots 25 are positioned 180 degrees from each other. The key slots 26 are configured uniquely for each gun to match the key lugs described with FIG. 3. The key slots 26 are positioned relative to the two retaining lug slots so the key can be inserted in either of two orientations which are 180 degrees from each other. The design of the keylock recess 22 permits the key to be inserted quickly because the key will fit in the keylock recess in two positions.

FIG. 5 shows the lower portion of a gun handle with key 11 inserted in the gun. The key is held in the gun because retaining lugs 17 and 18 rest on retaining pins 20 which are held in place by the pressure of retaining springs 21. If force is exerted on the lanyard, retaining lugs 17 and 18 slip past retaining pins 20 to allow the key to be pulled from the gun. FIG. 5 also shows the keylock recess 22 which is countersunk in a tapered fashion into the handle of the gun so as to guide the key into the keylock recess. The recessed nature of the symmetrical keylock recess allows the owner to insert key 11 with no visual cues as would be necessary at night.

Figure 6:
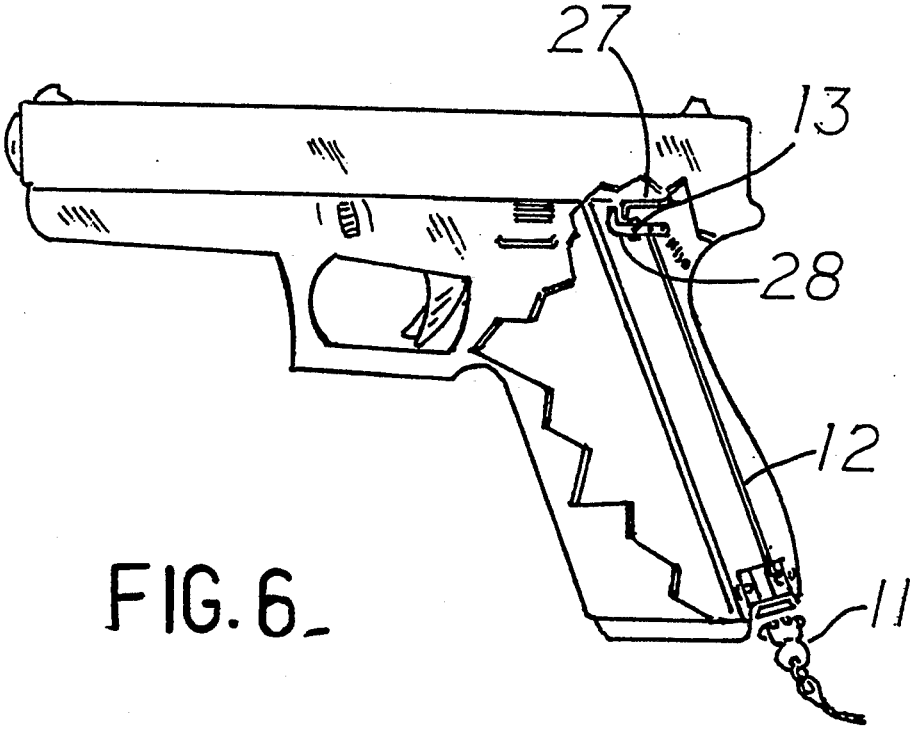
FIG. 6 shows an elevation of an alternative embodiment of the gun safety lock installed in a pistol.
Figure 7:
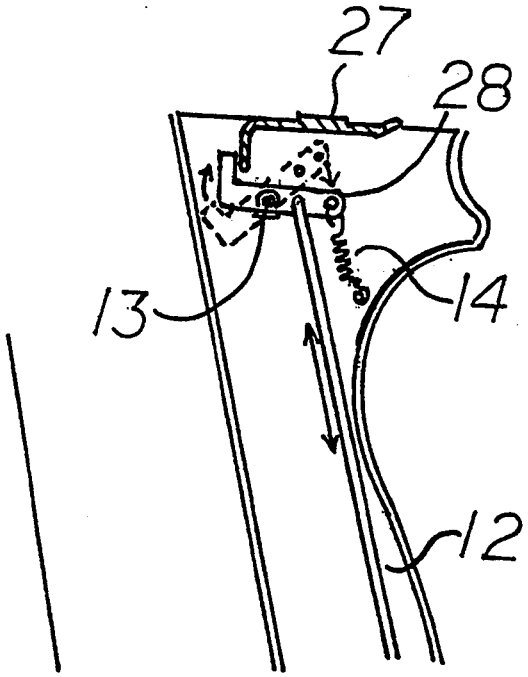
FIG. 7 shows an enlarged elevation of the pistol handle in FIG. 6.

FIG. 6 shows a pistol with an alternative embodiment of the gun safety lock. Because trigger bar 27 of this pistol must move forward to fire the gun, the trigger lock 28 prevents the trigger bar from moving forward. When key 11 is inserted, it pushes up on enabling bar 12 which causes trigger lock 28 to turn on pivot pin 13 thereby moving out of the path of trigger bar 27 so the gun can be fired. FIG. 7 shows an enlarged view of the trigger lock in FIG. 6. Lock spring 14 serves to bias trigger lock 28 in a locked position. Enabling bar 12 pushes up on trigger lock 28 to cause the trigger lock to turn on pivot pin 13 and move out of the path of trigger bar 27.

In guns where the hammer or trigger bar does not provide straight-line access for the rigid metal enabling bar to push the hammer or trigger lock out of the path of the hammer or trigger bar, a flexible cable can be used in lieu of the rigid metal enabling bar.

Although the gun safety lock will work with any type of gun or weapon which is equipped with a hammer or trigger bar, the preferred embodiment of the gun safety lock works with handguns such as pistols and revolvers. The preferred embodiment will be modified to each gun depending on the position of the hammer or trigger bar in the gun and the direction in which the hammer or trigger bar slides to activate the firing mechanism. In its preferred embodiment, all components of the gun safety lock are made of metal.

I claim:

1. A safety device for preventing the unauthorized firing of a weapon comprising:

(a) a key further comprising at least two lugs protruding from the key;

(b) a key receiving means for receiving said key, said receiving means further comprising at least two slots for receiving said lugs, said slots allowing full insertion of said key;

(c) a key retaining means disposed in said key receiving means for engaging said lugs on said key whereby said key is retained in said key receiving means in the fully inserted position until removed by a pulling force exerted on said key; and (d) a weapon deactivating means for disabling a weapon upon removal of said key from said key receiving means, and enabling said weapon upon only full insertion of said key into said key receiving means without rotation of said key;

whereby the spacing of said lugs on said key and the spacing of said slots in said key receiving means provides a method of unique matching of said key and said key receiving means.

2. A safety device for preventing unauthorized firing of a weapon comprising:

(a) a barrel key further comprising two retaining lugs, said retaining lugs spaced at 180 degrees on a barrel of said barrel key, and two groups of key lugs, said groups of key lugs having the same number of key lugs and having the same relative spacing between said key lugs, and each said group of key lugs having the same relative position with respect to a said retaining lug;

(b) a key receiving means for said said barrel key having an aperture for receiving said barrel key with said retaining lugs and said groups of key lugs whereby said barrel key can be inserted in said key receiving means in two orientations, each orientation being 180 degrees from the other orientation;

(c) a key retaining means disposed in said key receiving means for engaging at least one said retaining lug on said key whereby said key is retained in said receiving means until removed by a pulling force exerted on said key;

(d) a weapon deactivating means for disabling said weapon upon insertion of said key into said key receiving means; and (e) a lanyard, said lanyard having a key end and a body end, said key end attached to said key and said body end attached to the body of a user.

3. A device as in claim 2 wherein said key retaining means comprises two retaining pins, said retaining pins disposed so that said retaining lugs of said key engage said retaining pins when said key is fully inserted in said receiving means, and further comprising a retaining spring disposed at each said retaining pin, said spring causing a retaining force to be exerted on said retaining lug by said retaining pin whereby a pulling force is required to remove said key from said receiving means.

4. A safety device as in claim 3 wherein said key receiving means is disposed in a handle of said weapon.

5. A safety device as in claim 4 wherein said key receiving means is recessed in a bottom of said handle of said weapon whereby said key may be inserted easily in said key receiving means even in poor visibility.

6. A safety device as in claim 5 wherein said weapon deactivating means comprises:

(a) a hammer lock for preventing a weapon hammer from moving in a firing position when engaged;

(b) a pivot pin which allows said hammer lock to pivot between a engaged position and a disengaged position;

(c) a lock spring, said lock spring disposed so as to bias said hammer lock in the engaged position; and (d) an enabling bar having a bottom end and a top end, said top end connected to said hammer lock and said bottom end positioned in said key receiving means so that when said key is inserted in said key receiving means, said key engages said enabling bar and pivots said hammer lock against lock spring pressure to disengage said hammer, thereby enabling said weapon.

7. A safety device as in claim 5 wherein said weapon deactivating means comprises:

(a) a trigger lock for preventing a weapon trigger bar from moving in a firing position when engaged;

(b) a pivot pin which allows said trigger lock to pivot between a engaged position and a disengaged position;

(c) a lock spring, said lock spring disposed so as to bias said trigger lock in the engaged position; and (d) an enabling bar having a bottom end and a top end, said top end connected to said trigger lock and said bottom end positioned in said key receiving means so that when said key is inserted in said key receiving means, said key engages said enabling bar and pivots said trigger lock against lock spring pressure to disengage said trigger bar, thereby enabling said weapon.

* * * * *